United States Patent [19]

Wochnowski

[11] 3,957,063

[45] May 18, 1976

[54] METHOD AND APPARATUS FOR INCREASING THE VOLUME OF MOIST TOBACCO

[75] Inventor: Waldemar Wochnowski, Hamburg, Germany

[73] Assignee: Hauni-Werke Körber & Co., KG, Hamburg, Germany

[22] Filed: Apr. 19, 1974

[21] Appl. No.: 462,522

Related U.S. Application Data

[62] Division of Ser. No. 220,848, Jan. 26, 1972, Pat. No. 3,881,498.

[30] Foreign Application Priority Data

Jan. 27, 1971 Germany ..... 2103669

[52] U.S. Cl. ..... 131/140 P

[51] Int. Cl.[2] ..... A24B 1/02; A24B 3/02; A24B 9/00; A24B 15/00

[58] Field of Search ..... 131/133–137, 131/140; 34/1

[56] References Cited

UNITED STATES PATENTS

| | | | |
|---|---|---|---|
| 2,408,434 | 10/1946 | Mann et al. | 34/1 |
| 2,596,183 | 5/1952 | Sowa | 131/137 X |
| 3,524,452 | 8/1970 | Moser et al. | 131/140 P |
| 3,683,937 | 8/1972 | Fredrickson et al. | 131/140 P |
| 3,749,103 | 7/1973 | Abbott et al. | 131/140 P |

FOREIGN PATENTS OR APPLICATIONS

| | | | |
|---|---|---|---|
| 738,726 | 8/1943 | Germany | 131/140 P |

*Primary Examiner*—Robert W. Michell
*Assistant Examiner*—V. Millin
*Attorney, Agent, or Firm*—Peter K. Kontler; John Kurucz

[57] ABSTRACT

Particles of a tobacco stream are first expanded by passing across a high-frequency field wherein they are exposed to the action of electromagnetic waves which effect a vaporization of moisture in the capillaries with attendant increase in volume. The thus expanded particles of the tobacco are thereupon conveyed through a drying zone wherein the particles are externally heated by hot air for a short period of time to thus effect rapid drying of strata immediately adjacent to external surfaces of the particles and to thereby stabilize the particles against shrinkage. In the last step, the tobacco stream is forcibly cooled with air to effect a condensation of vaporized moisture in the capillaries. The expansion of tobacco can be enhanced if the tobacco stream is caused to pass through a bath containing freon or another organic fluid having a boiling point lower than water before the tobacco stream is conveyed across the high frequency field.

7 Claims, 7 Drawing Figures

METHOD AND APPARATUS FOR INCREASING THE VOLUME OF MOIST TOBACCO

This is a division, of application Ser. No. 220,848 filed Jan. 26, 1972 now U.S. Pat. No. 3,881,498.

BACKGROUND OF THE INVENTION

The present invention relates to a method of increasing the volume of moist tobacco. More particularly, the invention relates to improvements in a method of increasing the volume of tobacco leaves or portions of leaves by subjecting such tobacco particles to the action of a high-frequency field which causes a vaporization of moisture in capillaries of tobacco particles with attendant expansion of capillaries and the resulting increase in volume of tobacco.

The minimum weight of cigarettes or analogous tobacco-containing articles is usually prescribed by law. Since the manufacturers try to maintain the weight of tobacco in a smokers' product as close to the minimum permissible weight as possible, and since the mass of such minimum quantity of tobacco is often insufficient to properly fill the wrapper of a cigarette or a like smokers' product, the manufacturers strive to expand (i.e., to increase the volume of) tobacco particles in order to make sure that a quantity of tobacco having the minimum permissible weight will produce an article having the desirable "feel" or firmness in the hand of a smoker and that particles of tobacco will be less likely to escape at the ends of rod-like tobacco fillers in cigarettes or the like. It is a well known fact that tobacco particles are more likely to escape at the ends of relatively soft cigarettes wherein the tendency of tobacco particles to shift is much more pronounced than in a relatively tightly packed cigarette.

German Pat. No. 738,726 discloses a method of increasing the volume of tobacco particles by subjecting such particles to the action of a high-frequency electric field, especially a field of ultrashort waves with an output of 4–5 watts per gram of tobacco. The high-frequency field causes vaporization of water in the capillaries of tobacco with attendant expansion, and the tobacco is thereupon immediately cooled. The reason for expansion of tobacco in a high-frequency field is that the temperature of water in capillaries (and hence the pressure of resulting steam rises too rapidly to allow for complete diffusion of steam through the walls of the capillaries. Thus, the rising steam pressure causes a desirable expansion of capillaries; such procedure is known as "puffing".

The immediate cooling of freshly expanded tobacco is considered necessary in order to avoid excessive losses in mositure content. The cooling action is sufficiently intensive to bring about a condensation of steam in the capillaries. It was found that the just described conventional treatment causes undesirable bursting of capillaries so that the expanded and cooled tobacco yields a relatively high percentage of tobacco dust. The bursting capillaries release the steam so that the latter can escape and thus allows for substantial contraction or shrinkage of tobacco. As a result of frequent bursting of capillaries, escape of steam and ensuing shrinkage, the maximum increase in volume of tobacco which is treated in accordance with the method of the aforementioned German patent is only in the range of about 20 percent. In other words, the increase in volume is far from satisfactory, especially when compared with the outlay for machinery and energy which must be utilized to first subject tobacco to the action of a high-frequency field and to thereupon immediately cool freshly expanded tobacco in order to avoid an excessive reduction in moisture content.

SUMMARY OF THE INVENTION

An object of the invention is to provide a novel and improved method of increasing the volume of tobacco leaves fragments of tobacco leaves or other particles of tobacco according to which the gain in the volume of tobacco is much higher than in accordance with heretofore known methods, which yields a relatively small percentage of tobacco dust, and which reduces the likelihood of bursting of capillary walls subsequent to expansion.

Another object of the invention is to provide a method according to which the expansion and subsequent treatment of tobacco particles can be completed within extremely short intervals of time, in a small area, and with an acceptable reduction in moisture content.

A further object of the invention is to provide a method which can be resorted to for expansion of many types of tobacco and which can be practiced in presently known tobacco processing plants.

The method of the present invention is employed for increasing the volume of tobacco, such as tobacco particles constituting portions of or entire tobacco leaves. The method comprises the steps of subjecting moist tobacco to the action of a high-frequency field (preferably to the action of high-frequency electromagnetic waves) so as to vaporize the moisture in the capillaries of tobacco with attendant expansion or volumetric increase of tobacco particles, subjecting the thus expanded tobacco to a short-lasting external heating action, preferably by intimately contacting such tobacco by currents of hot air or another suitable gaseous fluid (e.g, for a period of 3 to 9 seconds) to effect rapid drying of tobacco adjacent to the external surfaces of tobacco particles, and thereupon subjecting the thus externally heated tobacco to a cooling action to effect a condensation of vaporized moisture therein, preferably by bringing about a forced exchange of heat between heated tobacco and atomspheric air or another suitable fluid coolant.

The tobacco is preferably transported in the form of a continuous stream, and the step of subjecting freshly expanded tobacco to a short-lasting external heating action may comprise agitating the tobacco stream while moving it lengthwise and intimately contacting the agitated stream with currents of hot air. The agitating step may comprise vibrating the tobacco stream in the drying zone so that the agitated stream moves lengthwise in the form of a turbulent layer which is traversed by currents of hot air. Alternatively, the step of subjecting freshly expanded tobacco to a short-lasting external drying action may comprise conveying the tobacco stream along a predetermined confining path by and in a current of hot air so that the heating medium serves as a carrier for tobacco during transport through the drying zone.

At least a portion of the moisture content of tobacco prior to expansion may be due to the presence in tobacco capillaries of an organic fluid, such as freon, having a boiling point which is lower than the boiling point of water. This can be achieved by conveying the tobacco stream through a bath of organic fluid and thereupon into the range of the high-frequency field.

If the tobacco is externally heated in a pneumatic conveyor by intimate contact with a hot gaseous fluid, the flow of such fluid is preferably concurrent with the direction of transport of tobacco. The same preferably holds true when the tobacco stream is transported through the drying zone by a vibratory conveyor. The transport of tobacco through the cooling zone preferably (but not necessarily) takes place in the same way as through the drying zone, i.e., by a vibratory conveyor (which may be the same conveyor which transports tobacco through the drying zone) or by a current of gaseous coolant which serves as a carrier for surface-dried tobacco during transport through the cooling zone.

The novel feature which are considered as characteristic of the invention are set forth in particular in the appended claims. The improved method itself, however, together with additional features and advantages thereof, will be best understood upon perusal of the following detailed description of certain specific embodiments of apparatus for the practice of the method with reference to the accompanying drawing.

DESCRIPTION OF THE PREFERRED EMBODIMENTS

Figure 1:
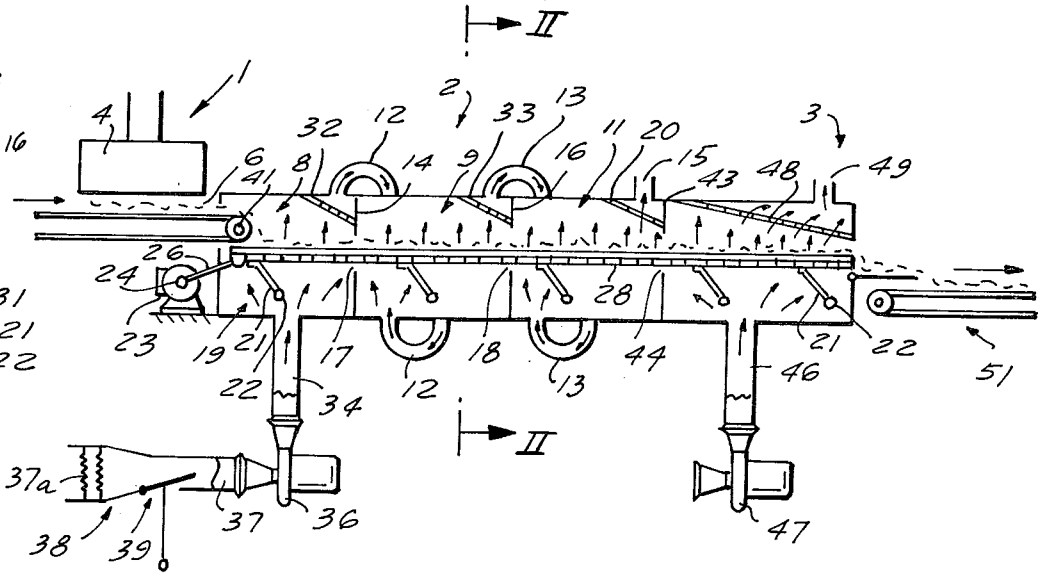
FIG. 1 is a schematic central longitudinal vertical sectional view of a first apparatus for increasing the volume of moist tobacco.
Figure 2:
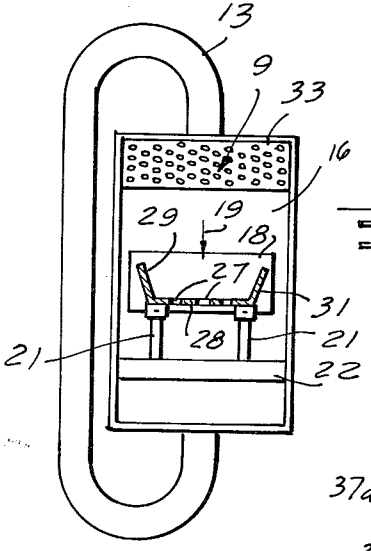
FIG. 2 is an enlarged transverse vertical sectional view as seen in the direction of arrows from the line II—II of FIG. 1.

The apparatus of FIGS. 1 and 2 comprises a heating unit 1, a drying unit 2 and a cooling unit 3. The heating unit 1 preferably comprises a microwave emitter or sender 4, for example, a sender of the type known as MAGNETRON (trademark) produced by the West German Firm Deutsche Mikrowellengesellschaft and similar to those employed in certain types of baking ovens. The sender 4 emits high-frequency electromagnetic waves to heat the moisture in the capillaries of tobacco 6 which is being transported by a conveyor belt 7 of the heating unit 1 so that the stream of tobacco 6 passes across the high-frequency field of the sender 4.

The drying unit 2 comprises a series of chambers 8, 9 and 11 which communicate with each other by means of pipes 12 and 13 serving to circulate a hot gaseous fluid (preferably air) which heats tobacco 6 after the latter advances beyond the high-frequency electromagnetic field. The last chamber 11 of the drying unit 2 has an outlet 15 which is located behind a sieve 20 or an analogous foraminous tobacco intercepting device. The chambers 8, 9 and 9, 11 are respectively separated from each other by partitions 14 and 16 which are provided with openings 17 and 18 for a transporting device 19 here shown as a vibratory or shaker conveyor which has a foraminous bottom wall or platform 28 mounted on carriers 22 by means of pairs of leaf springs 21 and receiving recurrent movements from a drive including an electric motor 23 whose output shaft drives an eccentric 24. The latter transmits motion to a connecting rod 26 which is articulately coupled to the platform 28 of the transporting device 19. The apertures 27 (e.g., perforations) of the platform 28 are shown in FIG. 2. The transporting device 19 further comprises two side walls 29 and 31 which flank the platform 28 and are inclined upwardly and outwardly (see particularly FIG. 2). The intake ends of the aforementioned pipes 12, 13 for hot air are located behind sieves 32 and 33. The means for supplying hot air to the drying unit 2 comprises a supply conduit 34 which admits hot air into the bottom region of the first or foremost chamber 8 below the platform 28 and receives hot air from the pressure side of a blower 36. The suction side of the blower 36 is connected with a second supply conduit 37 having a preferably open intake end **37*a* for atmospheric air and containing an electric resistance heater 38. A manually or automatically adjustable mixer valve 39 is mounted in the supply conduit 37 downstream of the heater 38 to regulate the rate of admission of unheated atmospheric air to the air stream which has been heated by the device 38. In this way, the operator or an automatic detector can regulate the temperature of hot air which enters the chamber 8 by way of the supply conduit 34**.

The discharge end of the aforementioned conveyor belt 7 in the heating unit 1 extends into the chamber 8 at a level above the platform 28 and is trained over a roller 41. The heated tobacco 6 which reaches the roller 41 descends by gravity to be intercepted by the platfrom 28 and to be conveyed through the chambers 8, 9 and 11 of the drying unit 2.

The cooling unit 3 comprises a compartment 42 which is located immediately downstream of and is separated from the last chamber 11 of the drying unit 2 by a partition 43 having an opening 44 for the platform 28 and side walls 29, 31 of the transporting device 19. The means for admitting a cooling fluid (preferably air) into the compartment 42 comprises a supply conduit 46 which communicates with the compartment 42 at a level below the platform 28 and receives relatively cool atmospheric air from the pressure side of a blower 47. The outlet 49 of the compartment 42 is separated from the major part of the internal space of the cooling unit 3 by a sieve 48 or an analogous tobacco intercepting device. A removing or take-off conveyor 51 is provided to receive treated tobacco 6 from the compartment 42 of the cooling unit 3 and to transport such tobacco to a further processing station, not shown.

The operation:

The belt 7 of the heating unit 1 transports tobacco 6 (with a moisture content in the range of between about 18 and 20 percent) across the electromagnetic field which is produced by the sender 4. The high-frequency energy generated by the emitter or sender 4 heats the moisture in the capillaries of tobacco 6 so that the moisture is converted into steam and its volume increases to effect a desirable stretching or expansion of capillaries under the action of steam pressure. In other words, the tobacco is inflated as a result of steam pressure in its capillaries, not unlike a balloon which is being filled with air. The thus heated and expanded tobacco 6 reaches the roller 41 at the discharge end of the conveyor belt 7 in the chamber 8 of the drying unit 2 and descends onto the left-hand end portion of the platform 28 to advance in the channel defined by the trough-shaped transporting device 19. The latter transports successive increments of the tobacco stream through the chambers 8, 9, 11 of the drying unit 2 and thereupon into and through the compartment 42 of the cooling unit 3. The blower 36 supplies into the lower region of the chamber 8 a current of hot air (whose temperature is determined by the setting of the flap of the mixer valve 39 in the supply conduit 37) whereby such air passes through the apertures 27 of the platform 28, across the tobacco stream in the chamber 8, through the sieve 32, through the pipe 12 which connects the upper region of the chamber 8 with the lower region of the chamber 9, through the platform 28 in the chamber 9, through the tobacco stream in this chamber, thereupon through the sieve 33, through the pipe 13 which connects the upper region of the chamber 9 with the lower region of the chamber 11, through the platform 298, through the tobacco stream in the chamber 11, and through the sieve 20 and outlet 15 to be discharged into the atmosphere or to the recirculated to the intake end 3*a* of the supply conduit 37.

It will be noted that the width of the channel defined by the platform 28 and side walls 29, 31 of the trough-shaped transporting device 19 increases in the direction of air flow through the platform 28 (i.e., upwardly, as viewed in FIG. 1 or 2), so that the speed at which the particles of tobacco rise under the action of currents of hot air in the drying unit 2 decreases. As the platform 28 vibrates under the action of the eccentric 24 which drives the connecting rod 26, it causes the layer of tobacco 6 thereon to rise and fall so that the particles of tobacco are continuously agitated and are intimately contacted by currents of hot air which pass upwardly through the apertures 27 of the platform 28. It can be said that the mass of tobacco in the chambers 8, 9 and 11 of the drying unit 2 forms a turbulent layer wherein the particles move relative to each other and relative to the platform 28 under the action of the motor 23 as well as under the action of ascending currents of hot air which pass through the apertures 27. This insures a highly intensive and hence satisfactory exchange of energy between tobacco 6 and hot air. It will be noted that the flow of hot air which contacts the particles of tobacco 6 in the drying unit 2 is substantially at right angles to the direction of transport of such particles from the heating unit 1 toward the cooling unit 3. The drying process which takes place in the unit 2 can be termed an external drying action with currents of air which are conveyed concurrently with the tobacco stream because the tobacco particles are contacted with hot air at a maximum temperature in the first chamber 8 and with hot air at lowest temperature in the last chamber 11.

The very hot air which comes into contact with tabacco particles in the first chamber 8 of the drying unit 2 brings about an abrupt or sudden drying of the stratum adjacent to the external surface of each freshly expanded tobacco particle. The drying action in the second and third chambers 9, 11 serves mainly to stabilize the effect which is produced in the first chamber 8 without effecting any appreciable drying in the inner stratum or strata of tobacco. This will be readily appreciated since the temperature of hot air in the chambers 9 and 11 is respectively lower than in the chambers 8 and 9, and also because the mositure content of air in the chambers 9 and 11 is respectively higher than in the chambers 8 and 9. Since the main purpose of the drying unit 2 is to effect a preferably abrupt drying action upon the outermost stratum of each tobacco particle which leaves the belt 7 of the heating unit 1, the drying unit 2 could operate properly with a single chamber, e.g., with the chamber 8. If the drying unit 2 comprises a single chamber, such single chamber 8 is preferably at least slightly longer then the illustrated chamber 8.

The rapid drying of exposed surfaces of tobacco particles in the chamber or chambers of the drying unit 2 stabilizes the volume of such particles so that they remain expanded or puffed, i.e., the volume of such particles does not decrease appreciably during transport by the platform 28 through the drying unit 2. The transporting device 19 immediately introduces the freshly surface-dried tobacco particles into the compartment 42 of the cooling unit 3 wherein the particles are subjected to the cooling action of currents of relatively cool air which is supplied into the lower region of the compartment 42 by the blower 47 through the intermediary of the supply conduit 46. The intensive cooling of tobacco particles in the turbulent tobacco layer above the upper side of the platform 28 in the compartment 42 brings about a reduction of the steam pressure in the capillaries of tobacco particles and the condensation of steam. The condensation of steam is desirable in order to prevent penetration of stream into the outer strata of tobacco particles because such penetration could result in softening of the abruptly cooled and dried outer strata immediately adjacent to the external surfaces of tobacco particles. The dried skin of each tobacco particle acts not unlike a shell to prevent shrinkage (reduction in volume) of tobacco particles during cooling with attendant drop of steam pressure in the capillaries. Consequently, the increased volume of tobacco particles is preserved and stabilized during transport through the units 2, 3 so that the volume of tobacco particles which reach the removing conveyor 51 considerably exceeds the volume of tobacco particles which are expanded or puffed in accordance with the heretofore known methods.

Figure 7:
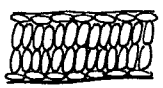
FIG. 7 illustrates the tobacco particle of FIG. 6 after the increase in volume.
Figure 6:
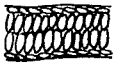
FIG. 6 is a section through a tobacco particle before the increase in volume.

For example, the tobacco which is being fed onto the belt 7 of the heating unit 1 can be maintained at room temperature and the temperature of expanded tobacco particles downstream of sender 4 may be between 40°–99°C. The temperature of hot air in the chambers 8, 9, 11 of the drying unit 2 may vary between 180°–80°C. As mentioned above, the moisture content of tobacco 6 which is fed onto the belt 7 may be in the range of 18–20 percent, and the moisture content of tobacco leaving the compartment 42 of the cooling unit 3 may be about 13 percent. The increase in volume of the tobacco (leaf tobacco and cut tobacco rag) is in the range of up to 30 percent (compare FIGS. 6 and 7). The speed of the tobacco stream on the belt 7 can be selected in such a way that the interval required by a tobacco particle to travel across the electromagnetic field which is produced by the sender 4 is between 10–40 seconds. The length of the period of dwell of tobacco particles in the chambers 8, 9, 11 of the drying unit may be between 3 and 9 seconds. It is clear that the above data are furnished merely by way of example since the temperature of hot air in the drying unit 2, the initial moisture content of tobacco, the speed of tobacco transport across the electromagnetic field, and/or the speed of transport of tobacco through the units 2 and 3 will depend on a number of factors, such as the nature of tobacco, the size of tobacco particles, the rate at which the width of the platform 28 increases in the direction of tobacco transport, the construction of the sender 4 and/or others.

The electromagnetic field which is produced by the sender 4 insures very rapid and reliable vaporization of moisture in the capillaries of tobacco 6. The next-following step, i.e., the action of hot gaseous fluid in the chambers 8, 9 and 11 of the drying unit 2, has been found to produce an unexpected and highly desirable effect, namely, it prevents bursting of capillaries and it also stabilizes the walls of capillaries to thus prevent appreciable shrinkage during cooling in the unit 3. The external heating action of hot air has been found to be particularly satisfactory for such purposes.

The forcible cooling of tobacco in the drying unit 3 also consitutes a novel step of the improved method. Such forcible cooling results in rapid condensation of steam in the expanded capillaries of tobacco 6 to thus prevent gradual softening of capillary walls which would take place if the tobacco 6 leaving the unit 1 or 2 were allowed to cool slowly, e.g., merely by exposure to a stagnant body of atmospheric air. Softening of capillary walls, as a result of gradual condensation of steam therein, would permit excessive shrinkage of such walls so that the major part of beneficial expanding action in the heating unit 1 would be lost.

The heating of tobacco 6 in a high-frequency field, especially a high-frequency electromagnetic field, brings about the advantage that, in contrast to heating of an entire tobacco particle with stream which causes the capillary walls to become porous and to permit excessive escape of vaporized moisture, the high-frequency field heats mainly the moisture in the capillaries but the heating action upon the tissue of tobacco particles (which is a poor conductor of heat) is much less pronounced.

A gradual reduction of the speed of air currents with pass upwardly through the apertures 27 of the platform 28 is desirable in order to insure that the air currents cannot entrain lighter tobacco particles above the main layer of tobacco which is being agitated in the channel of the transporting device 19. This is achieved in a very simple way by providing the transporting device 19 with side walls 29, 31 whose internal surfaces diverge outwardly and upwardly to thus effectively reduce the speed of air currents which pass through the apertures 27. In other words, the speed of air currents decreases proportionally with their distance from the apertures 27.

Figure 3:
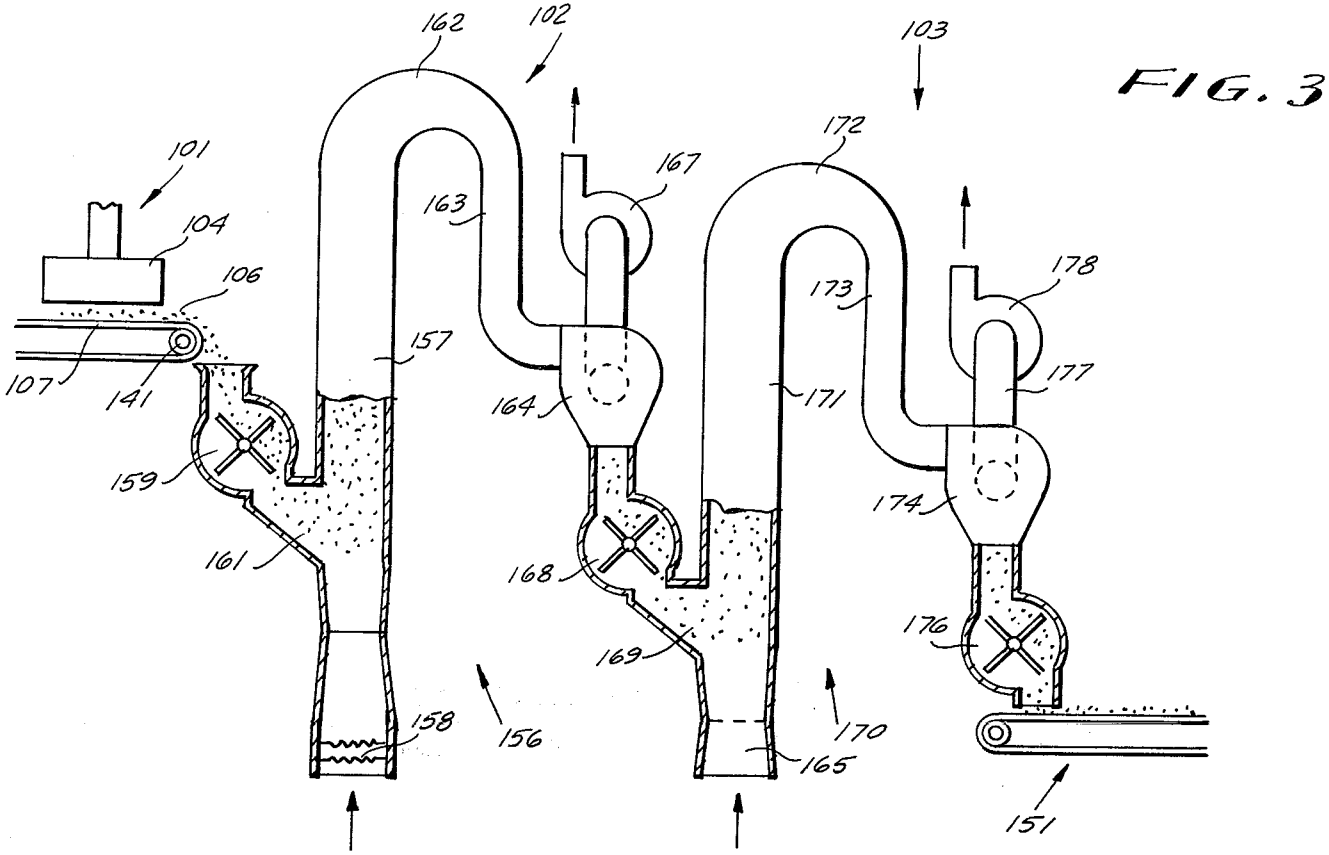
FIG. 3 is a schematic central longitudinal vertical sectional view of a second apparatus.

FIG. 3 illustrates certain details of a second apparatus which is provided with pneumatic transporting devices for freshly expanded tobacco particles. All such parts of the second apparatus which are identical with or clearly analogous to the corresponding parts of the apparatus shown in FIGS. 1–2 are denoted by similar reference characters plus 100. The heating unit 101 comprises an endless belt 107 which is trained over rollers 141 (only one shown) and transports a stream of tobacco 106 across the electromagnetic field produced by a sender 104. The expanded particles of tobacco 106 descend into an air lock 159 and enter the drying unit 102 which comprises a pneumatic transporting device 156 for expanded tobacco. The device 156 includes an upright duct 157 which is a functional equivalent of the chamber 8 of the drying unit 2 and receives expanded tobacco by way of a chute 161 located downstream of the air lock 159. The lower end of the duct 157 is open to admit atmospheric air which is heated by a preferably adjustable electric resistance heater 158. The upper end portion of the duct 157 forms an elbow 162 of gradually decreasing cross sectional area (as considered in the direction of tobacco transport) which communicates with an upright intermediate pipe 163 serving to deliver freshly surface-dried tobacco particles into an air separator 164 which is connected with a blower 167 serving to evacuate air whereby the expanded and surface-dried tobacco particles descend into a second air lock 168. The connection between the separator 164 and blower 167 comprises a suction pipe 166.

The air lock 168 delivers tobacco particles into the cooling unit 103 which comprises an upright duct 171 corresponding to the compartment 42 of the cooling unit 3. The lower portion 165 of the cooling duct 171 receives freshly expanded and surface-dried tobacco particles by way of a chute 169 which is located immediately downstream of the air lock 168. The lower end of the duct 171 is open to admit cool atmospheric air which serves as a carrier for tobacco particles and is drawn upwardly by a blower 178 connected with an air separator 174 by a suction pipe 177. The upper end portion of the duct 171 forms an elbow 172 of a gradually diminishing cross-sectional area which discharges cooled tobacco particles into an upright intermediate pipe 173 for delivery into the air separator 174. The latter furnishes cooled tobacco particles to an air lock 176 which discharges tobacco onto a removing or take-off conveyor 151. The reference character 170 denotes the pneumatic transporting device of the cooling unit 103. It will be noted that the construction of the drying unit 102 is practically identical with that of the cooling unit 103 and that these units share the feature of embodying devices 156, 170 for pneumatic transport of tobacco 106.

The operation of the apparatus of FIG. 3 is as follows:

The belt 107 transports a stream of tobacco 106 across the electromagnetic field which is produced by the sender 104 of the heating unit 101 whereby the tobacco expands in the same way and for the reasons explained in connection with FIGS. 1–2. The freshly expanded tobacco 106 is caused to descend at the right-hand end of the belt 107 and is introduced into the drying unit 102 by way of the air lock 159 which admits the expanded tobacco particles into the lower portion of the duct or chamber 157 by way of the chute 161. The expanded tobacco particles are entrained by the ascending current of hot air which enters the lower end of the duct 157 and is heated by the device 158 to an elevated temperature which suffices to insure satisfactory surface drying of tobacco particles during transport from the chute 161, by way of the elbow 162, pipe 163 and into the air separator 164. The current of hot air in the duct 157 brings about a desirable agitation and loosening of freshly expanded tobacco particles to insure rapid and effective surface drying of each tobacco particle prior to entry into the cooling unit 103. It will be seen that the tobacco particles entering the duct 157 by way of the chute 161 are first contacted by hot air which is maintained at a maximum temperature (it having been heated by the device 158 immediately or closely upstream of the point where the chute 161 communicates with the duct 157). This brings about the aforedescribed abrupt surface-drying action to prevent deflation or collapse of tobacco particles during the next stage or stages of transport through the units 102 and 103.

The freshly expanded and surface-dried tobacco particles pass through the air lock 168 to be admitted into the cooling duct or compartment 171 by way of the chute 169. The ascending current of cool air which enters the duct 171 by way of the lower portion 165 entrains the tobacco particles toward and through the elbow 172 whereby such particles descend in the pipe 173 and are separated from air in the device 174. The agitating action of cool air in the duct 171 is an analogous to the action of hot air in the duct 157. Due to rapid energy exchange between tobacco and cool air in the duct 171, the steam pressure in the tobacco particles decrease, the stream is condensed and the outermost strata of tobacco particles remain dry to prevent any appreciable shrinkage in the cooling unit 103. The particles which leave the air lock 176 descend onto the take-off conveyor 151 and are transported to a further processing station.

Figure 4:
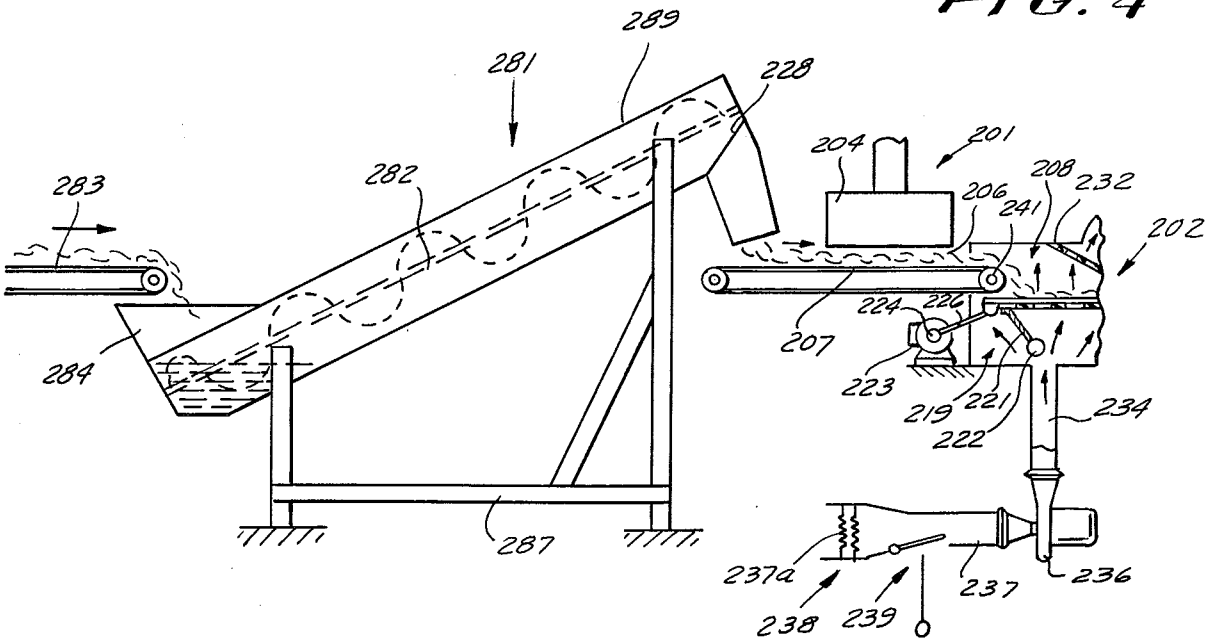
FIG. 4 is a schematic side elevational view of a moistening device for tobacco which is fed to the apparatus of FIG. 1 or 3.

FIG. 4 illustrates a portion of a third apparatus which constitutes a modification of the apparatus of FIGS. 1–2 and wherein all such parts which are identical with or clearly analogous to the corresponding parts of the apparatus of FIGS. 1–2 are denoted by similar reference characters plus 200. The apparatus of FIG. 4 comprises a feeding unit 281 which serves to deliver specially prepared tobacco 206 onto the upper stretch of the belt 207 in the heating unit 201. The feeding unit 281 comprises a vessel 284, a feed screw 282 which serves to transport tobacco from the vessel 284 upwardly toward a chute 288 which dumps tobacco onto the belt 207, a cylinder or barrel 289 wherein the feed screw 282 rotates (the motor or other suitable drive means for rotating the feed screw 282 is not shown in FIG. 4), a supply of an organic fluid 286 in the vessel 284, and a conveyor 283 which delivers tobacco to the vessel. The barrel 289 of the feeding unit 281 is mounted on a frame 287 which also supports the vessel 284 and the chute 288. The details of the drying unit 202 and cooling unit (not shown in FIG. 4) are preferably identical with those of the corresponding units in the apparatus of FIGS. 1–2. The organic fluid 286 in the vessel 284 is freon or any other suitable organic fluid with a low boiling point. Such fluid may be maintained at a temperature of about 30°C.

The operation of the apparatus of FIG. 4:

The belt 283 delivers a stream of tobacco 206 directly into the vessel 284 which is partially filled with organic fluid 286. The particles of tobacco 206 are enriched with such organic fluid and are conveyed by the feed screw 282 to move in the barrel 289 and to descend onto the upper stretch of the belt 207 in the heating unit 201 by way of the chute 288. The expansion of tobacco particles during travel across the electromagnetic field produced by the sender 204 of the heating unit 201 takes place substantially in the same way as described in connection with FIGS. 1 and 2. The organic fluid enchances the expansion of tobacco particles due to its low boiling point, i.e., due to the fact that its volume increases more rapidly than that of water. Thus, even through the supply of energy furnished by the heating device 201 need not be increased beyond that in the cooling unit 1 of FIGS. 1 and 2, the expansion of tobacco particles on the belt 207 is more pronounced. The freshly expanded tobacco particles are thereupon dried and cooled in the same way as described in connection with FIGS. 1 and 2.

The method which can be carried out with an apparatus embodying the structure of FIG. 4 constitutes an improvement over conventional methods according to which tobacco is merely soaked in or impregnated with an organic fluid and is thereupon heated in a hot gaseous fluid. Such conventional methods also insure some expansion of tobacco but the permanent expansion is much less pronounced that if the soaking with organic fluid is followed by transport of tobacco through a high-frequency field, immediate external heating with a hot gaseous fluid and immediate forced cooling with a gaseous fluid medium.

An important advantage of the improved method and apparatus is that the abrupt drying of freshly expanded tobacco prevents any appreciable shrinkage of such tobacco so that the volume of tobacco leaving the cooling unit considerably exceeds the volume of tobacco which leaves a conventional apparatus. As explained above, this is attributed to the fact that the strata immediately adjacent to the surface of tobacco particles act as shells which prevent a collapse or shrinkage of particles subsequent to cooling which is desirable in order to reduce the steam pressure and to effect a condensation of steam. It was found that the increase in volume of tobacco particles which are treated in accordance with the method of the present invention is a multiple of the volumetric increase of tobacco paticles which are treated in accordance with heretofore known methods. The organic fluid which is used in the apparatus of FIG. 4 brings about an even more pronounced expansion of tobacco particles without necessitating the consumption of larger amounts of energy for operation of the heating unit 201. This is attributed to more pronounced expansion of freon and analogous organic fluids having a lower boiling point than water.

It is further clear that the improved apparatus is susceptible of many additional modifications without departing from the spirit of the present invention. For example, the feeding unit 281 of FIG. 4 can be utilized to feed tobacco to the heating unit 101 of FIG. 3, the drying unit 202 of FIG. 4 may comprise a single chamber or only two chambers, and the length of the cooling duct 171 in the apparatus of FIG. 3 may be greater or less than that of the duct 157. It is further clear that each of the three illustrated apparatus can be provided with suitable means for changing the initial moisture content of tobacco, the speed of transport of tobacco through the heating unit and/or the speed of transport of tobacco through the drying and/or cooling unit.

Figure 5:
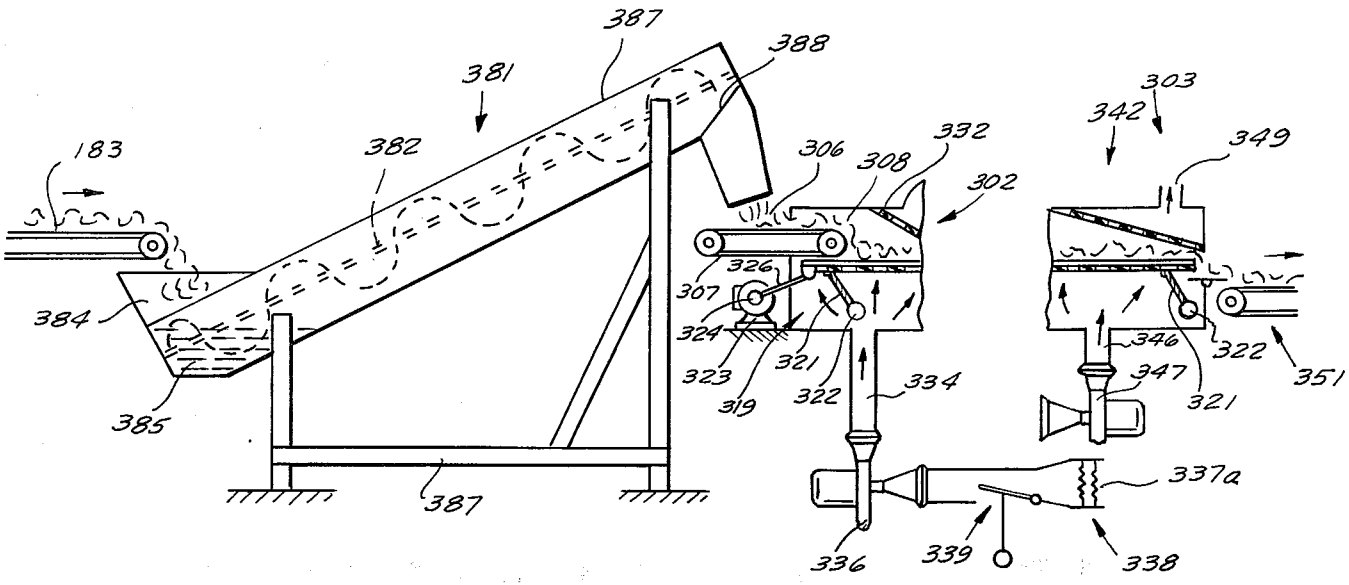
FIG. 5 is a schematic side elevational view of a modification of the moistening device of FIG. 4.

FIG. 5 illustrates a modification of the apparatus of FIG. 4 without an arrangement for the production of high-frequency energy. Parts which correspond to those of FIG. 4 are denoted by similar same reference characters plus 100 and are not further described. The apparatus of FIG. 5 is distinguished from the apparatus of FIG. 4 in that the feeding device 381 contains ordinary water and that no arrangement for the production of high-frequency energy is mounted adjacent to the belt 307. This apparatus is particularly suitable for increasing the volume of cut tobacco stems which can absorb a large amount of moisture.

The operation of the apparatus of FIG. 5 is as follows:

The tobacco is delivered by the belt 383 into the feeding unit 381. The vessel 384 with water 385 is arranged in the bottom region of the feeding unit 381 so that the tobacco falls directly into the water 385 from the belt 383. The tobacco, which is soaked with water, is conveyed by the feed screw 382 from the vessel 384 to the chute 388. The tobacco, which has a moisture content of over 40 percent $H_2O$, is conveyed by the belt 307 into the chamber 308 of the drying unit 302 where the tobacco is transferred onto the transporting device 319. As already described in connection with FIG. 1, hot air is circulated around the tobacco to effect an abrupt drying action upon the external surfaces of the tobacco particles which stabilizes the external surfaces of the tobacco particles in their expanded form, so that the expanded tobacco does not shrink during the subsequent removal of surplus moisture. With the method of increasing the volume, an increase in volume in the range of up to 50 percent is achieved in the case of cut tobacco stems.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. A method of increasing the volume of tobacco, comprising the steps of subjecting tobacco to an intensive moistening action with attendant expansion of tobacco; subjecting the thus expanded tobacco to a short-lasting external heating action which is sufficient to effect the drying of tobacco in the outer strata immediately adjacent to the external surfaces of tobacco; stopping said external heating so that the hardness of said outer strata substantially exceeds the hardness of the inner strata of tobacco; and thereupon subjecting the thus externally heated tobacco to a cooling action with resulting pronounced stabilization of the volume of tobacco, including effecting a force exchange of heat between tobacco and a fluid coolant.

2. A method as defined in claim 1 wherein, as a result of said intensive moistening action, the moisture content of tobacco prior to said external heating action exceeds 40 percent.

3. A method as defined in claim 1, wherein said step of subjecting tobacco to said external heating action comprises effecting an exchange of heat between tobacco and a hot gaseous fluid.

4. A method as defined in claim 3, wherein said hot gaseous fluid is air.

5. A method as defined in claim 3, wherein said tobacco forms a stream of tobacco particles which are conveyed in a current of said hot gaseous fluid whereby the gaseous fluid heats the outer strata of said particles.

6. A method as defined in claim 1, wherein said tobacco forms a stream of tobacco particles and said step of subjecting tobacco to said external heating action comprises conveying said stream lengthwise, simultaneously agitating said particles so that said stream forms a turbulent layer, and intimately contacting the particles of said turbulent layer with currents of a hot gaseous fluid.

7. A method as defined in claim 1, wherein the tobacco is subjected to said external heating action of an interval of 3 to 9 seconds.

* * * * *